US006065505A

United States Patent [19]

Fickers

[11] Patent Number: 6,065,505

[45] Date of Patent: May 23, 2000

[54] HELIX SEAM FOR WOVEN PAPERMAKING DRYER FABRICS

[76] Inventor: Gisela Fickers, Windmühlenweg 24, B-4700 Eupen, Belgium

[21] Appl. No.: 09/155,044

[22] PCT Filed: Mar. 15, 1997

[86] PCT No.: PCT/EP97/01347

§ 371 Date: Sep. 17, 1998

§ 102(e) Date: Sep. 17, 1998

[87] PCT Pub. No.: WO97/35065

PCT Pub. Date: Sep. 25, 1997

[30] Foreign Application Priority Data

Mar. 19, 1996 [DE] Germany ..... 196 10 616

[51] Int. Cl.[7] ..... D21F 1/00

[52] U.S. Cl. ..... 139/383 AA; 162/904; 428/222

[58] Field of Search ..... 139/383 AA; 24/33 C, 24/33 K; 162/904; 428/222

[56] References Cited

U.S. PATENT DOCUMENTS

| | | | |
|---|---|---|---|
| 1,747,272 | 2/1930 | Webb | 139/383 AA |
| 4,141,388 | 2/1979 | Romanski et al. | 139/383 A |
| 4,574,435 | 3/1986 | Luciano et al. | 139/383 AA |
| 4,649,619 | 3/1987 | Romanski | 139/383 AA |
| 4,827,579 | 5/1989 | Gisbourne | 139/383 AA |
| 5,488,976 | 2/1996 | Lorenz et al. | 139/383 AA |

FOREIGN PATENT DOCUMENTS

| | | |
|---|---|---|
| 324110 | 8/1975 | Australia . |
| 813486 | 6/1937 | France . |
| 2449792 | 2/1976 | Germany . |
| 2806742 | 9/1978 | Germany . |

*Primary Examiner*—Andy Falik
*Attorney, Agent, or Firm*—Volpe and Koenig, P.C.

[57] ABSTRACT

A stitched seam for high-tensile woven fabric strips, in particular for dryer screen fabric for paper machine clothing, wherein the warp thread loops of the two fabric sections to be interconnected are connected at the location of the common seam by a closure wire. At least one of the two outer regions of the two fabric strip sections to be interconnected comprises a worked-in helix at the location of the seam. Each of the helices embraces at least one weft thread and the closure thread. The other region of the stitched seam of the ends of the two fabric strip sections consists of the loops formed by the warp threads of the fabric.

6 Claims, 2 Drawing Sheets

HELIX SEAM FOR WOVEN PAPERMAKING DRYER FABRICS

BACKGROUND

The invention relates to a stitched seam for high-tensile woven fabrics especially for dryer fabric for paper machine clothing in which the warp yarn loops of the two fabric sections to be interconnected are connected together at the location of the common seam by means of a closure wire.

In so-called loop stitch seams the fabric edge is basically that portion which is subjected to the greatest stress. If excessive tensions are created in the fabric, there frequently occurs in those portions a so-called eyelet rupture, which requires repair or replacement of the fabric.

The object of the invention is to strengthen this weak spot and thereby prevent the risk of an eyelet rupture, or at least reduce it, and thereby increase the life span of such fabrics.

This object is achieved in accordance with the invention by providing at least one of the two outer regions of the two fabric sections which are to be interconnected at the seam location with at least one worked-in helix, while the remaining portion of the stitched seam at the ends of the two fabric sections consists of the loops formed by the warp yarns of the fabric.

Further embodiments of the invention are the subject of the dependent claims.

SUMMARY

The stitched seam constituting the invention consists essentially of an extraneous material which takes the shape of a helix and is worked into at least one, but generally into both edge portions of the two fabric sections. In this way there is created a stitched seam which consists of two different seam systems and which results in strengthening precisely the weak spots, namely the outer regions of the fabric. In contrast to a conventional loop seam, in which only every second yarn can be used as a connecting yarn, so that the seam strength is approximately 50% of the fabric tear strength, by using a seam reinforcement in accordance with the invention, the helices are held in by all the warp yarns so that a substantial increase in seam tear strength is achieved compared to a loop seam. In so doing, the tear strength is primarily a function of the strength of the helices, i.e., their diameter and their material properties.

The helix configuration is such that a helix is worked into each of the left and right edge portions of the confronting free ends of the two fabric sections. At the locations of the helices the warp yarns protrude, in loop shape, equally far into the end region, whereas, in the remaining portion of the fabric web, they are displaced with respect to each other in the lengthwise direction in conventional manner and the loops of the two fabric sections alternately protrude differently far, so that only every second loop of each of the two fabric sections encircles the connecting wire.

The ends of the two helices in the two fabric sections are attached toward the fabric center. At the edge, the respective helix end portion is straightened and pulled back toward the fabric and at the transition from the loop seam a straightened piece is worked in so that the helix ends cannot be pulled out. The working-in of the helices can take place at the same time as the production of the loop seam but it is also readily possible to work the helices in separately at a later time.

BRIEF DESCRIPTION OF THE DRAWINGS

In what follows the invention is explained with reference to the drawing by means of illustrative examples. There is shown in FIG. 1 an illustration in principle of the stitched seam according to the invention, in open position, FIG. 1*a* an illustration in principle corresponding to FIG. 1 in closed position, FIG. 2 a detailed illustration of a segment of the seam construction in accordance with the invention in the closed position, seen from above, FIG. 3 an illustration of the stitched seam in the form of a circular fragment of FIG. 2, but only the stitched seam portion of fabric section 1,

DETAILED DESCRIPTION OF THE PREFERRED EMBODIMENT

Figure 1:
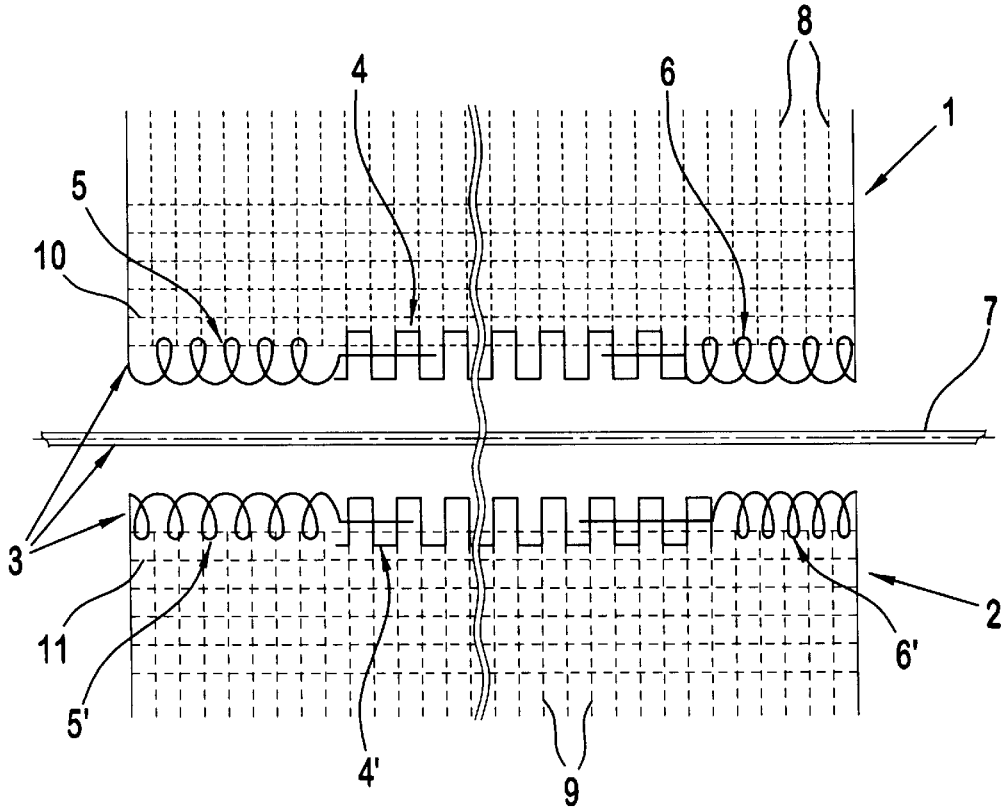
Figure 1A:
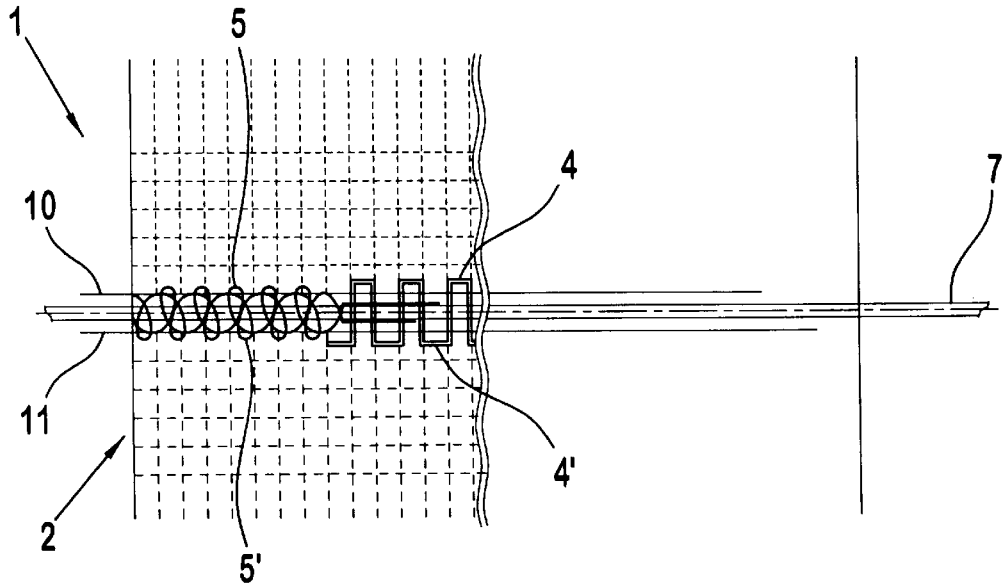

FIG. 1 shows the ends of two fabric sections 1 and 2, which are connected to each other by a common stitched seam 3. The stitched seam 3 consists of several parts and has in each of the two fabric sections a loop stitch seam 4, 4' in the center portion of each fabric section, as well as a reinforcing helix seam 5, 6, 5', 6' at the two outer regions of each fabric section. The closure wire which passes through both seam systems and the seam connections 4–6, 4'–6' is designated by the reference numeral 7.

Figure 2:
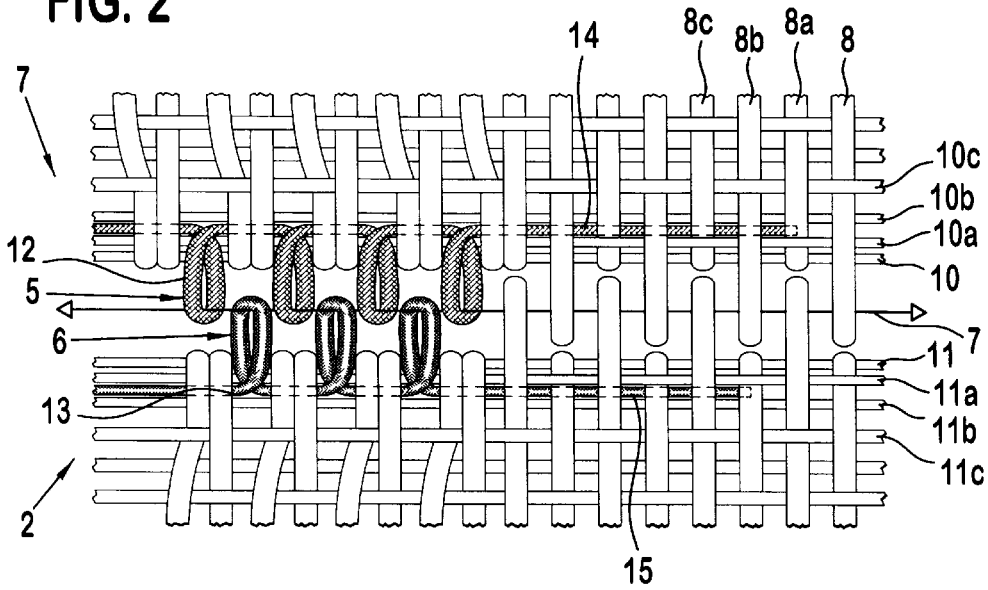
Figure 3:
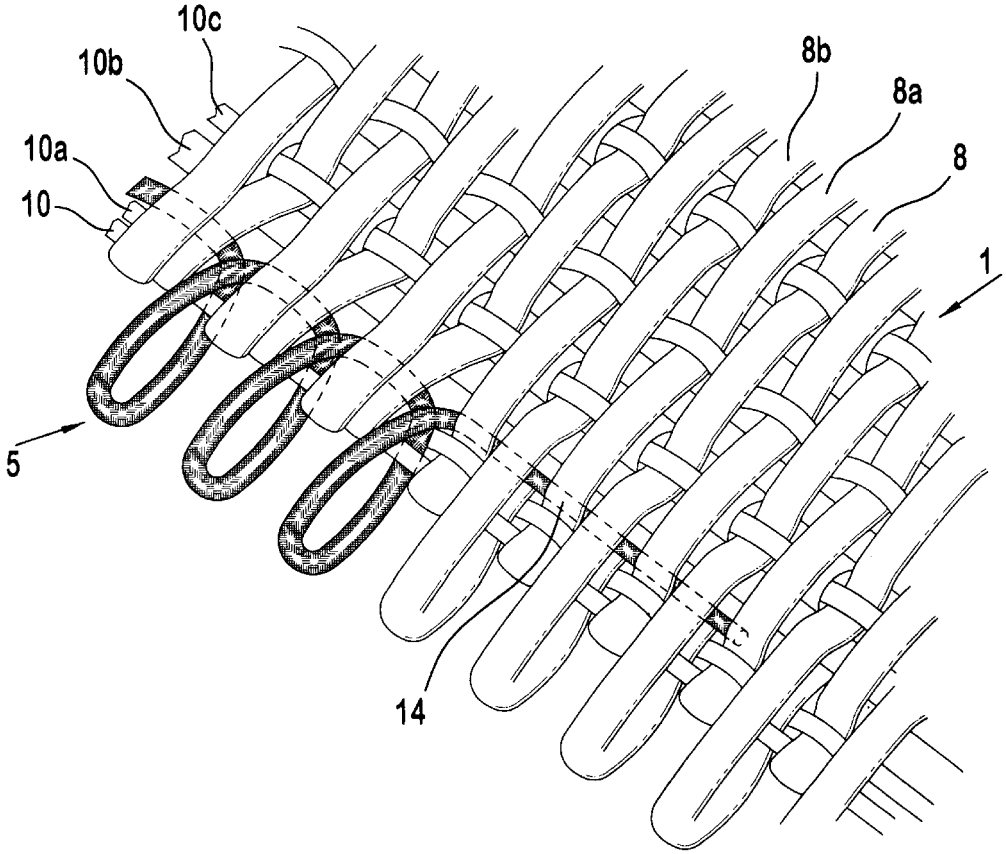

The warp yarns of fabric section 1 are designated as 8, 8*a*, 8*b*, 8*c* . . . in FIGS. 2 and 3, the warp yarns of the fabric section 2 are designated as 9, 9*a*, 9*b*, 9*c* . . . , the warp yarns of fabric section 1 as 10, 10*a*, 10*b* . . . and the warp yarns of fabric section 2 as 11, 11*a*, 11*b* . . . .

Helix 12 of helix seam connection 5 is worked into fabric section 1, helix 13 into fabric section 2. In the separate fabric sections which are to be connected to each other, the loops of helices 12 and 13 are located in each other's interstices and overlap in the lengthwise direction of the fabric web sufficiently that the connecting wire 7 can pass through the loops of both helices 12 and 13; at the same time, in the remaining portion of the fabric web (outside the helix structure) which takes the form of a conventional loop seam, this connecting wire 7 passes alternately through the loops of adjoining parallel warp yarns, as shown in detail in FIG. 2. The helix ends take the form of extensions 14, 15 of helices 12, 13 and, after the end portion of each helix is straightened out and pulled back toward the fabric, are attached in the interior of the fabric by means of the lengthwise yarns. Preferably the helices 5 and 6 are worked in simultaneously with the loop seam 4, so that they form an initial component of the fabric sections 1 and 2 which are to be interconnected. However, optionally, they could also be worked in separately, at a later time.

Helices 12 and 13 embrace within their loops the common connecting wire 7 which, in the area of the helix-reinforced seam connection 3, passes, respectively, through one turn of helix 12 and one of helix 13, the turns of helices 12, 13 being arranged, for example, in each other's interstices to provide the connection of the two fabric sections 1 and 2 in the area of reinforcement, in place of the loops of the warp yarns of the two sections 1 and 2. The loop seam in the remaining portion of the seam connection of the fabric web is formed in conventional manner. In so doing, each helix 12 and 13 encloses the closure wire 7 and one cross machine direction (CMD) yarn 10 or several cross machine direction yarns 10, 10*a*, 10*b*.

Each helix is preferably manufactured from polyetheretherketone (PEEK), polyphenylere sulfide (PPS), polyethylene terephthalate (PET), polyamide (PA), polycarbonate (PC), aramide, metal or the like and is preferably matched to the materials used for the fabric.

I claim:

1. A stitched seam for a fabric web including interwoven warp and weft yarns defining opposed ends and opposed edges, the warp yarns defining yarn loops at each end of the fabric to be interconnected at a common connection location by means of a closure wire, the seam characterized in that at least a portion of each end of the fabric is provided with a worked-in helix, each of the helices enclosing at least one weft yarn and defining at least one helix loop adjacent the respective yarn loops, such that a closure wire channel that includes a plurality of yarn loops and at least one helix loop is defined at each end of the fabric, whereby the channels are aligned and the closure wire inserted through the yarn loops and helix loops to seam the fabric.

2. Stitched seam according to claim 1 characterized in that a worked-in helix is provided adjacent each fabric edge and the remainder of each channel between the two worked-in helices consists of yarn loops.

3. Stitched seam according to claim 1, characterized in that each helix consists of polyetheretherkeytone (PEEK), polyphenylere sulfide (PPS), polyethylene terephthalate (PET), polyamide (PA), polycarbonate (PC), aramide, metal or the like and is matched to the materials used for the fabric.

4. Stitched seam according to claim 1 further characterized in helix loops of one end of the fabric alternating with helix loops of the other end of the fabric when the channels are aligned.

5. Stitched seam according to claim 1 further characterized by each portion of the fabric provided with a worked-in helix including at least two adjacent helix loops.

6. Stitched seam according to claim 5 further characterized in that at least two warp yarns are positioned between adjacent helix loops.

* * * * *